United States Patent [19]

Carlson et al.

[11] Patent Number: 4,593,491

[45] Date of Patent: Jun. 10, 1986

[54] ALARM SENSOR APPARATUS FOR CLOSURES

[75] Inventors: James A. Carlson, Thornton; Lawrence M. Stoddard, Arvada, both of Colo.

[73] Assignee: The United States of America as represented by the United States Department of Energy, Washington, D.C.

[21] Appl. No.: 575,599

[22] Filed: Jan. 31, 1984

[51] Int. Cl.[4] ..... G08B 13/08

[52] U.S. Cl. ..... 49/13; 340/547; 340/693

[58] Field of Search ..... 49/13, 14; 160/10; 116/12, 13, 85, 86, 204, 230, 267; 200/61.93, 61.71; 340/547, 693

[56] References Cited

U.S. PATENT DOCUMENTS

| | | | |
|---|---|---|---|
| 800,216 | 9/1905 | Kales | 49/14 |
| 1,211,448 | 1/1917 | Hubbs | 200/61.71 |
| 1,237,993 | 8/1917 | Bahde | 200/61.71 |
| 1,994,940 | 3/1935 | Butters | 49/14 X |
| 2,756,990 | 7/1956 | Reamey | 49/13 X |
| 3,771,153 | 11/1973 | Byrne . | |
| 3,975,723 | 8/1976 | Bowling et al. | 340/547 |
| 4,062,314 | 12/1977 | Allen et al. | 49/13 X |
| 4,232,309 | 11/1980 | Dillitzer | 340/547 |
| 4,271,338 | 6/1981 | Rakocy | 340/547 X |
| 4,462,023 | 7/1984 | Nielsen et al. | 340/693 X |

*Primary Examiner*—William E. Lyddane
*Assistant Examiner*—James R. Brittain
*Attorney, Agent, or Firm*—James H. Chafin; Albert Sopp; Judson R. Hightower

[57] ABSTRACT

An alarm sensor apparatus for closures such as doors and windows, and particularly for closures having loose tolerances such as overhead doors, garage doors or the like, the sensor apparatus comprising a pair of cooperating bracket members, one being attached to the door facing or frame work and the other to the door member, two magnetic sensor elements carried by said bracket members, the bracket members comprising a pair of cooperating orthogonal guide slots and plates and a stop member engageable with one of the sensors for aligning the sensors with respect to each other in all three orthogonal planes when the door is closed.

4 Claims, 4 Drawing Figures

ALARM SENSOR APPARATUS FOR CLOSURES

The U.S. Government has rights in this invention pursuant to Contract No. DE-AC04-76PD3533 between the U.S. Department of Energy and Rockwell International Corporation.

BACKGROUND OF THE INVENTION

1. Field of the Invention

The present invention relates to closure alarm switches and more particularly, but not by way of limitation, to an alarm sensor mechanism to ensure alignment of magnetic sensor elements in a closure application.

2. History of the Prior Art

Door alarm mechanisms using magnetic sensor switching such as reed switches are well known as evidenced by the U.S. Pat. No. 3,771,153, issued Nov. 6, 1973 to Byrne. Such devices to be efficient and effective require that the two sensor elements be in rather accurate alignment when the door is in a closed position. When such devices are installed on close fitting windows, pivoting doors and the like, such alignment is normally obtainable.

However, alignment problems invariably occur when an attempt is made to utilize such devices on loosely fitting garage doors, overhead warehouse doors and the like. Simply attaching one sensor element to the door frame and the other to the door usually results in significant misalignment, giving rise to false alarms and/or incorrect status indications. Further, such misalignments can occur in all three mutually perpendicular planes.

Another problem associated with the installation of such sensors mechanisms on garage doors and overhead warehouse doors is that of inadvertently damaging the sensor mechanisms. Still another problem with the installation of such sensors is the ease in which the alarm system can be tampered with when the door mechanism is closed.

SUMMARY OF THE INVENTION

The present invention provides a closure alarm sensor apparatus which is particularly designed and constructed to effectuate alignment of cooperating magnetic sensor elements in closures having loose tolerances.

The apparatus comprises a pair of cooperating bracket members, one of which is attached to the moveable door member and the other being attached to the door facing or other frame structure.

Each of the brackets comprise an angle member and an end cap constructed of strong material such as stainless steel which, when in a closed position, forms a rectangular enclosure for housing the magnetic sensor elements and protecting the elements from inadvertent damage or from tampering.

The brackets also comprise cooperating orthogonally positioned guideslots and plates for forcing the brackets into alignment when the door is closed. One of the sensor elements is connected to one of the brackets by way of a compression spring and the other is provided with a stop member which serves to align the sensors in the direction of travel of the moveable door member.

Stated another way, the spring connections for the sensor and the stop member align the sensors in a plane perpendicular to the direction of travel of the door member. The guideslots at the plates serve to align the sensors in two other mutually orthogonal planes. Since the brackets are securely attached to the door member and the door frame, the guideslots and the plates actually force the door member adjacent to the brackets into a position to allow alignment of the sensors.

The bracket serve to not only align the sensor elements but to protect the sensor elements from damage or tampering when in a closed position. The alignment feature is particular useful with closures having loose tolerances such as overhead storage, warehouse doors, garage doors or the like. However, the sensor is also useful in connection with closures having close tolerances in that the bracket members prevent damage or tampering in any closure application.

DESCRIPTION OF THE DRAWING

Other and further advantageous features of the present invention will hereinafter more fully appear in connection with a detailed description of the drawings in which.

DESCRIPTION OF THE PREFERRED EMBODIMENT

Figure 1:
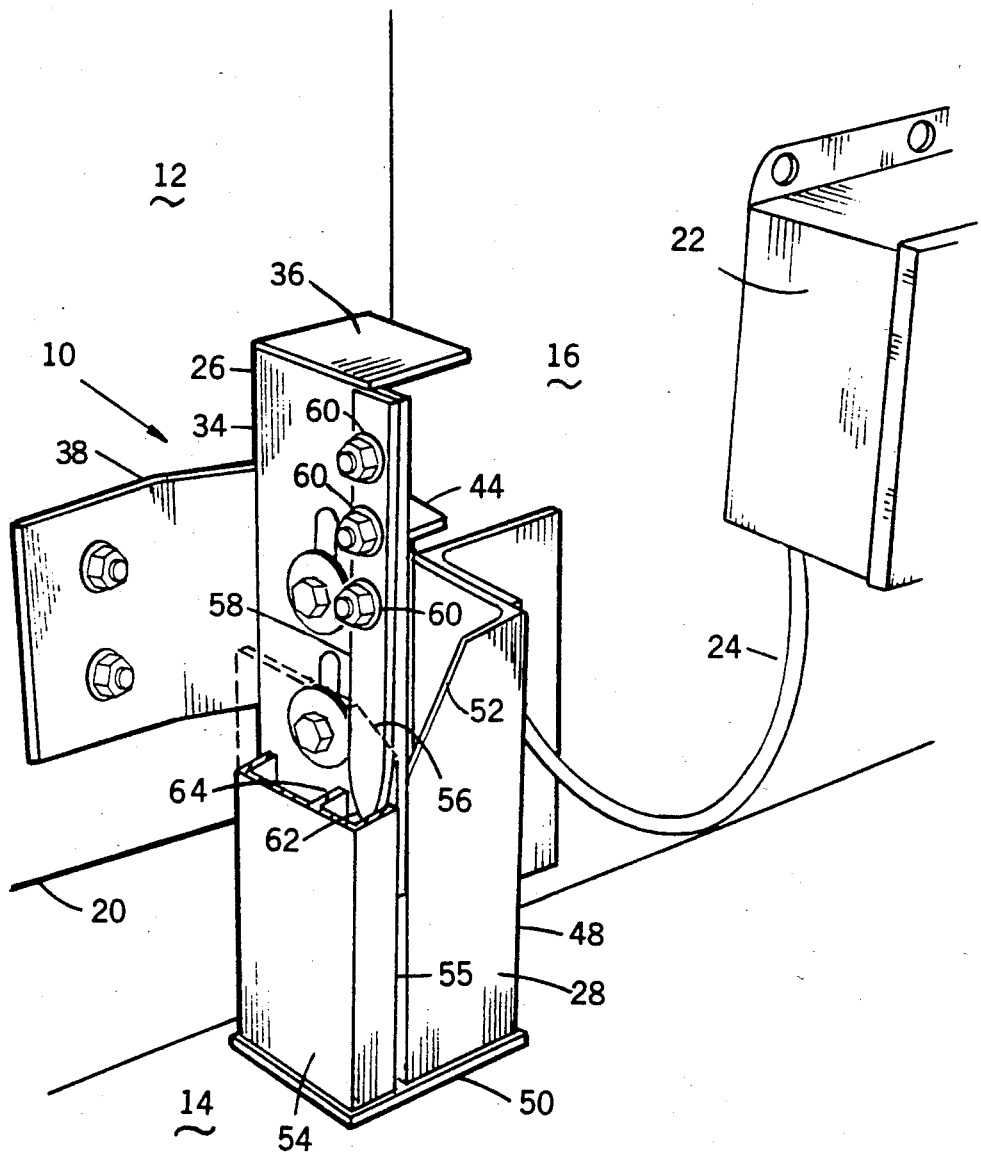
FIG. 1 is a perspective view of an alarm apparatus embodying the invention with a bracket shown partially cut-away.

Referring to the drawings in detail, reference character 10 generally indicates an alarm sensor apparatus for closures having an overhead door member 12 which closes downwardly against a floor element 14, the wall adjacent to door member 12 being indicated by referenced character 16. The sensor apparatus 10, naturally, can be attached to any suitable closure having a door 12 and suitable frame or facing members. It is noted in FIGS. 1 and 2 of the drawings, that door member 12 is partially opened and the bottom thereof is represented by reference character 20.

The alarm sensor 10 is electrically connected to an alarm apparatus or distribution box indicated by reference character 22 by a suitable cable 24.

The sensor apparatus comprises a pair of cooperating sensor bracket members 26 and 28 for housing a pair of sensor elements 30 and 32, respectively.

The bracket member 26 comprises an elongated angle iron member 34 which is vertically disposed and provided with an upper end cap or plate 36. The frame member is attached to the garage door by means of a pair of attachment plates 38 and 40 and suitable bolts 42.

The sensor element 30 is secured to a plate member 44, the upper end of which is yieldably attached to the top plate member 36 by a compression spring 46.

The bracket 28 comprises an elongated vertically disposed angle member 48 which is provided with a base plate member 50. The bracket 28 is secured to the doorfacing or frame 16 by angle members 29 and 31 with suitable bolts 33.

The orientation of the angle member 48 is such that when the door is in a closed position, the combination of the angle 48 and its based plate 50 with the angle member 34 and top plate 36 form a rectangular enclosure for protecting the sensor elements 30 and 32 from damage and from tampering.

Figure 2:
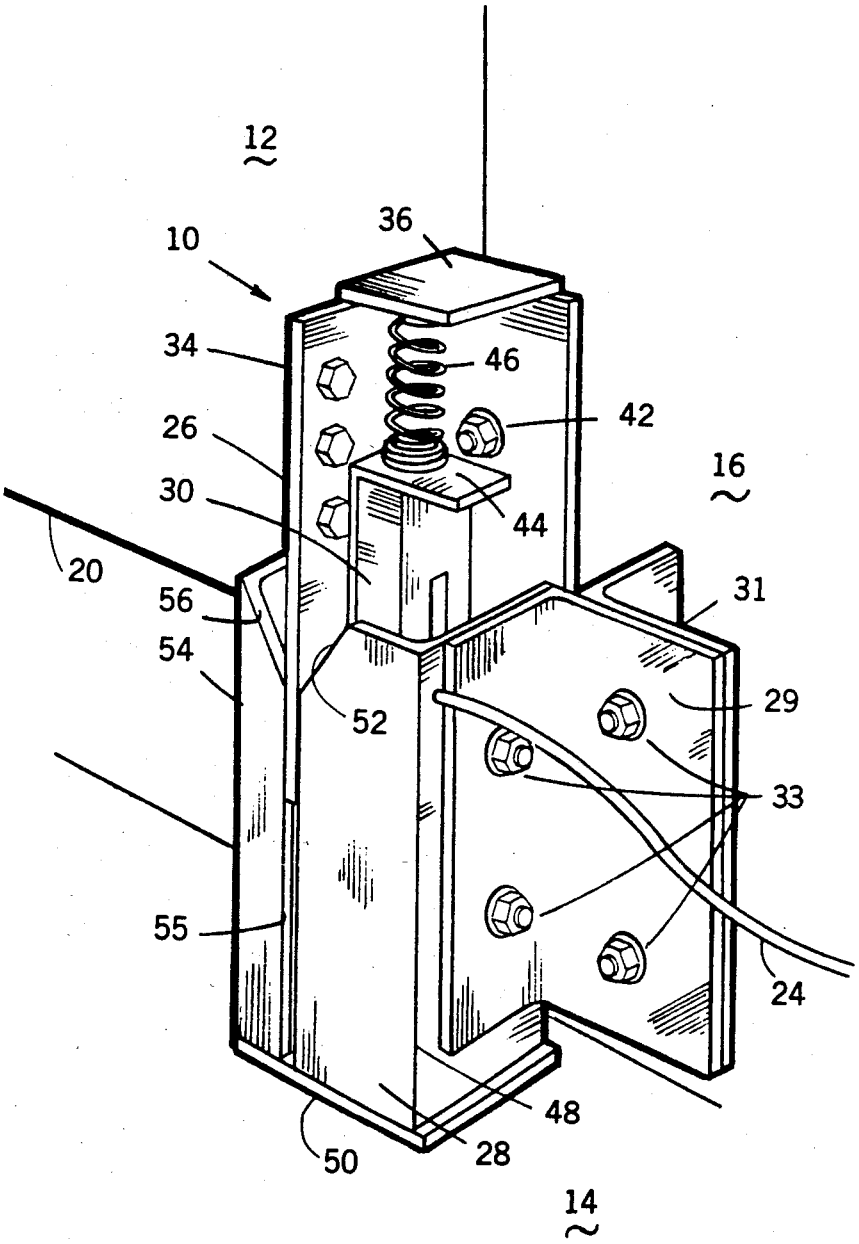
FIG. 2 is a perspective of the apparatus FIG. 1 taken at a different angle.
Figure 3:
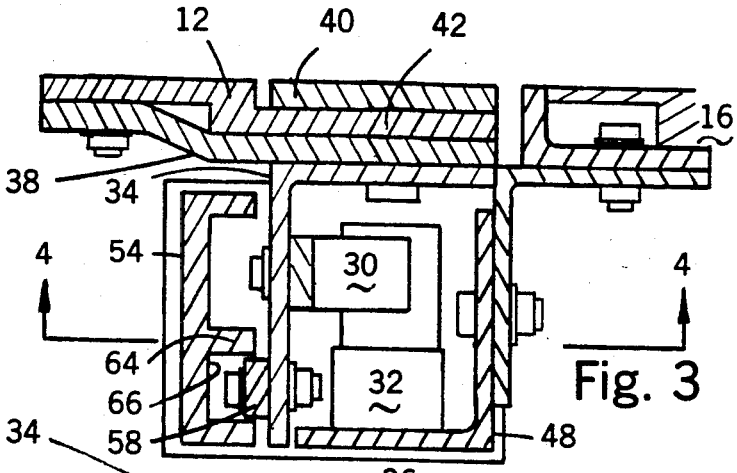
FIG. 3 is a plan sectional view of the apparatus of FIG. 1.

The upper outside edge of the angle member 48 is provided with a cut-off corner portion 52 as shown in FIGS. 1 and 2, for a purpose that will be hereinafter set forth. The bracket member 28 further comprises a vertically disposed, inwardly facing channel member 54 which is spaced from the angle 48 to form a vertical slot indicated by reference character 55. The upper end of the channel member 54 is provided with a downwardly and inwardly facing cut-off portion indicated by reference character 56 such that in conjunction with the cut-off portion 52, the bracket 28 forms a V-shaped guide channel for accepting and guiding the outer edge of the angle member 34 downwardly and into the slot 55 upon closure of the door 12 as shown in FIGS. 1 and 2.

Thus, the V-shaped angle cut-out portions 52 and 56 in conjunction with slot 55 serve to align the bracket members 26 and 28 in a horizontal direction in the plane containing the door member when the apparatus is closed.

An outer face of the angle member 34 is provided with a vertically disposed elongated plate member 58 which is secured thereto by plurality of bolts 60 as shown in FIG. 1. The lower end of the plate member 58 is provided with a tapered or pointed portion 62.

The inwardly facing channel member 54 is provided with an elongated divider plate 64, which in turn forms a channel 66 for receiving the elongated plate member 58 therein when the door is moved towards a closed position. Hence, the slot or groove 66 in connection with the plate member 58 serves to align the bracket and the door for that matter in a vertical plane perpendicular to the plane containing the door.

Therefore, it can be seen that since the bracket member 26 is rigidly attached to the door 12 and the bracket member 28 is rigidly attached to the frame structure 14 and 16, both the door 12 in the vicinity of the bracket members and the sensor elements 30 and 32 carried by the brackets are forced into alignment in orthogonal vertical planes upon closure of the door.

Figure 4:
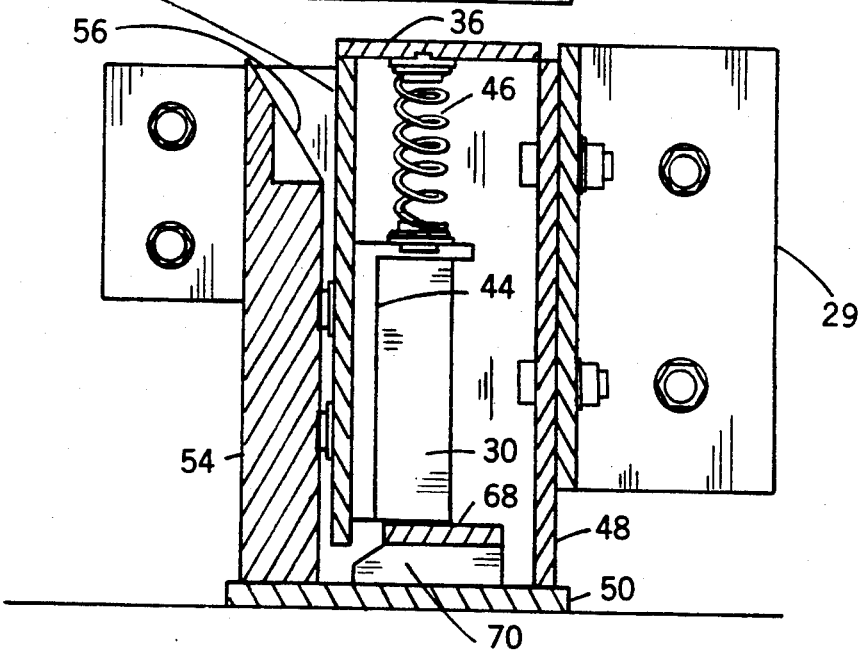
FIG. 4 is an elevational sectional view of the apparatus taken along the broken lines 4—4 of FIG. 3.

A stop plate or member 68 is secured to the base plate 50 by one or more mounting blocks 70 as shown in FIG. 4 of the drawings. The base plate 68 is set at a vertical height corresponding to the location of the sensor element 32, which is carried by the bracket member 28. Therefore, when the door is moved to a closed position as shown in the sectional view, FIG. 4 of the drawings, it can been seen that the sensor element 30 moves downwardly into contact with the base plate 68 and is held in that vertical position by means of the mounting compression spring 46. Therefore, when the door is moved to a closed position, the sensor element 30 is brought into vertical alignment with the sensor element 32 by means of the stop member or plate 68.

Hence, it can be seen that the sensor elements 30 and 32 are brought into rather accurate alignment when the door is closed in all three orthogonal planes.

It can be seen from review of the structure that, whereas sensor element 30 is yieldably attached to the moveable bracket 26, it could be attached to the stationary bracket 28 with the stop member being attached to the moveable bracket 26, all within the spirit of the invention.

Whereas the present invention has been particularly described in connection with the drawings attached hereto, other modifications, apart from those shown or suggested herein may be made within the spirit and scope of the invention.

We claim:

1. An alarm sensor apparatus for closures having a door facing and a door member which is moveable with respect to the facing, the sensor apparatus comprising:

a pair of cooperating bracket members, one attached to the facing and the other to the door member, two magnetic sensor elements, one supported by each bracket member, one bracket member comprising a pair of guide plates lying in orthogonal planes relative to each other and parallel to the direction of the movement of the door member, the other bracket member including, a pair of complementary guide slots orthogonal to each other for receiving said guide plates therein upon closure of the door member for aligning the sensors with respect the said two orthogonal planes, and a stop member carried by one of the bracket members and engageable with the sensor carried by the other bracket member for aligning the sensors in a third orthogonal plane upon closure of the door member.

2. An alarm sensor apparatus as set forth in claim 1 wherein one of the sensors is rigidly secured to the bracket member containing the stop member, and the other sensor is yieldably attached to the other bracket member such that said other sensor's position adjusts itself upon engagement with the stop member.

3. An alarm sensor apparatus as set forth in claim 1 wherein each bracket member comprises two perpendicular side walls made of angle material and an end plate such that upon closure, the brackets form a closed housing surrounding both of the sensor elements for protection of said sensor elements against damage and tampering.

4. An alarm sensor apparatus for closures having a door facing and a door member which is moveable with respect to the facing, the sensor apparatus comprising:

first and second bracket members;

the first bracket member secured to the door member and having an open end directed toward the second bracket member, first and second guide plates carried by the first bracket member and lying in orthogonal planes relative to each other and parallel to the direction of travel of the moveable door member, a first magnetic sensor element carried by the first bracket member; and the second bracket member secured to the door facing and having an open end directed toward the first bracket member, a second sensor element carried by the second bracket member, the second bracket member having complementary first and second guide slots orthogonal to each other for receiving said first and second guide plates therein for aligning the sensor elements with respect to said orthogonal planes, a stop plate carried by the second bracket member and engageable with the first sensor element upon closure of the door member for positioning said sensor elements with respect to a third plane perpendicular to said orthogonal planes.

* * * * *